US009051735B2

(12) United States Patent
Gerritsen

(10) Patent No.: US 9,051,735 B2
(45) Date of Patent: Jun. 9, 2015

(54) STRUCTURAL PANEL UNIT AND METHOD OF ASSEMBLING SAME

(75) Inventor: Christopher Hendrikus Johannes Gerritsen, Sint-Amandsberg (BE)

(73) Assignee: Arcelormittal Investigación Y Desarrollo SL, Sestao, Bizkaia (ES)

( * ) Notice: Subject to any disclaimer, the term of this patent is extended or adjusted under 35 U.S.C. 154(b) by 0 days.

(21) Appl. No.: 14/008,400

(22) PCT Filed: Mar. 31, 2011

(86) PCT No.: PCT/EP2011/055058

§ 371 (c)(1),
(2), (4) Date: Jan. 9, 2014

(87) PCT Pub. No.: WO2012/130321

PCT Pub. Date: Oct. 4, 2012

(65) Prior Publication Data

US 2014/0154522 A1 Jun. 5, 2014

(51) Int. Cl.
*E04C 2/36* (2006.01)
*E04C 2/28* (2006.01)

(52) U.S. Cl.
CPC ..... *E04C 2/36* (2013.01); *Y10T 428/1234* (2015.01); *Y10T 29/49629* (2015.01); *Y10T 428/24174* (2015.01); *E04C 2/28* (2013.01)

(58) Field of Classification Search
CPC ..... E04B 2001/747; E04B 2001/748; E04B 2001/8471; E04C 2/08; E04C 2/28; E04C 2/36; E04C 2001/747; E04C 2001/748; E04C 2001/8471; E04C 2002/3461
USPC ..... 52/662–664, 668, 669, 479, 783.1, 52/783.11, 784.14, 793.11, 653.1
See application file for complete search history.

(56) References Cited

U.S. PATENT DOCUMENTS

| | | | | |
|---|---|---|---|---|
| 2,645,985 | A * | 7/1953 | Beebe et al. | 52/667 |
| 4,573,304 | A * | 3/1986 | Mieyal | 52/793.11 |
| 2005/0069387 | A1 * | 3/2005 | Arollanes | 405/114 |
| 2006/0269720 | A1 | 11/2006 | Guanci | |

FOREIGN PATENT DOCUMENTS

| | | |
|---|---|---|
| DE | 20106495 U1 | 8/2001 |
| EP | 0754815 A1 | 1/1997 |
| GB | 467671 | 6/1937 |

* cited by examiner

*Primary Examiner* — Charles A Fox
*Assistant Examiner* — Patrick Maestri
(74) *Attorney, Agent, or Firm* — Reinhart Boerner Van Deuren P.C.

(57) ABSTRACT

Structural panel unit (10) comprising a first plate (11) and continuous web members (13, 14) extending along intersecting directions so as to support the plate (11), the web members (13, 14) being each slotted (141, 131) partway through at their intersections so that they fit into one another, the web members comprising first web members (13) and second web members (14), wherein the first web members (13) are so disposed as to have slots (131) open towards the first plate (11) in which slots (131) fit the second web members (14), wherein the first web members (13) are united to the first plate (11) thereby interlocking the second web members (14), and wherein the second web members (14) are linked to the first plate (11) by no other means than by interlocking with the first members (13). According to another aspect, web members extending along one of said intersecting directions can optionally comprise first partway through slots open towards one side and second partway through slots open towards the opposite side, the first and second slots fitting into intersecting web members. A method of assembling a structural panel unit according to the latter aspect is provided as well.

22 Claims, 5 Drawing Sheets

STRUCTURAL PANEL UNIT AND METHOD OF ASSEMBLING SAME

The present invention relates to a panel unit for structural use, such as in building and construction of load carrying structures. The panel unit comprises at least one plate reinforced by members arranged in a web-like fashion.

Structural panel units of the above kind are known from GB 467671, which discloses a metal floor element comprising metal top and bottom plates distanced apart and united together by a system of plate web-members disposed on intersecting lines. A similar panel unit is disclosed in DE 201 06 495, which has web-members that are slotted partway through to provide for interlocking. An advantage of such panel units is that due to the cross-linking of the web-members, shear stresses can be transmitted both lengthwise and crosswise of the panel. The above panel units therefore combine excellent stiffness properties with reduced weight and can be designed to carry extremely high loads.

There exist applications, in particular for manufacturing of large-sized structures, which typically require tailored solutions. A disadvantage of panel units of the above kind is that their manufacturing is labour intensive and requires dedicated clamping/tooling equipment. Therefore, manufacturing is limited to standard designs and dimensions, preventing the use of optimised, tailored panels. Aspects of the present invention provide for a solution to the above problem.

It will furthermore be apparent that the most cost effective way of assembling such panel units is by welding. In this regard, DE 201 06 495 and EP 0754815 disclose particular methods of welding the web-members to the top and bottom plates.

In order to meet the continuous demand for strength/weight optimization, GB 467671 and DE 201 06 495 disclose to produce the entire structure in light alloy or aluminium. However, in particular in applications wherein one skin requires specific properties, or in order to reduce material costs and/or improve overall panel properties, it would be advantageous to be capable of manufacturing panel units composed of dissimilar, possibly incompatible materials. However, a problem arises since incompatible materials cannot be united easily, such as by welding. Aspects of the present invention provide for a solution to this problem.

According to a first aspect of the invention, there is hence provided a panel unit, such as for structural applications, as set out in the appended claims. The panel unit comprises a first plate and continuous web members extending along intersecting directions so as to support the plate. The web members are each slotted partway through at the intersections so that they fit into one another. The first plate is made of a first material.

According to the present aspect of the invention, the web members comprise first web members and second web members. In order to link the first and second web members to the first plate, the first web members are so disposed that they have slots open towards the first plate. In the latter slots fit the second web members. The first web members are united to the first plate, preferably by welding, and thereby interlock the second members.

Hence, the second web members are disposed against the plate with slots facing away from the plate. The first web members are disposed with slots fitting into the above mentioned second web members' slots, which comes down to the latter slots being open towards the plate.

According to the present aspect of the invention, the second web members are linked to the first plate by no other means than by interlocking with the first members. For example, the second web members are preferably not welded to the first plate.

Hence, in order to assemble the entire unit, one needs only to unite (e.g. by welding) the first web members to the plate. As a result, the second web members are interlocked, without the need of further bonding to the plate, so that bonding/joining of second web members to the first plate and possibly to the first web members need not be performed. In order to prevent joining of the second web members when welding the first web members to the first plate, the second web members can be provided with notches opposite the slots.

A second plate can be provided at the opposite side relative to the first plate to provide for a double-skinned panel, wherein the web members are interposed between the first and second plates. Preferably, the second web members are so disposed as to have slots open towards the second plate, in which slots fit the first web members. The second web members are united to the second plate, such as by any fusion bonding technique and thereby interlock the first web members. Preferably, the first web members are linked to the second plate by no other means than by interlocking with the second web members.

The present aspect of the invention hence allows to provide a panel with (reinforcing) web members made of different, and possibly incompatible materials (incompatible towards one or more joining techniques involving melting of the materials, such as welding). The second web members can therefore be (entirely or in part) made of a second material different and possibly incompatible with a first material of which the first plate is made. The first web members can be (entirely or in part) made of the first material, or of a material which is similar and preferably compatible with the first material.

In case a second plate is present opposite the first plate as described above, the second plate can be made of the second material, or a material similar to and preferably compatible with the second material.

First web members can be disposed along first direction(s) and second web members can be disposed along second direction(s) intersecting with the first one(s). Alternatively, first and/or second web members can be disposed along both first direction (s) and second direction(s).

Advantageously, web members extending along one of the intersecting directions comprise first slots partway through the web member and open-ended towards one side and second slots partway through the web member and open-ended towards the opposite side. Both the first slots and the second slots fit into slots of intersecting web members. As will be explained, arranging some slots with the open ends towards the opposite side enables to set up an initial self-standing framework which can be filled up afterwards to create the web structure, thereby reducing expensive tooling needs and the amount of manual labour. This makes tailored panel units according to the invention cost effective.

According to a second aspect of the invention, there is provided a method of assembling a structural panel unit as set out in the appended claims. At least one first continuous web member and second continuous web members are provided, being each slotted partway through so that the first web member and second web members can fit into one another. At least one slot of each second web member is open-ended towards one side and other slots are open-ended towards the opposite side.

According to the method, the at least one first web member is arranged such that it has upwardly facing slots. The second web members are arranged so as to intersect the first web member and to interlock therewith by fitting the second web members' slots that are open-ended towards the one side into slots of the first web member. By so doing, a self-standing framework of web members is obtained with correct position and orientation of web members.

To obtain a web structure, the framework is completed with additional web members by slot-fitting them into the second web members' slots open-ended towards said opposite side. Finally, a plate is arranged on top of the web and is united to the web to obtain the panel unit.

The self-standing framework reduces tooling expenses and manual labour, and therefore reduces manufacturing costs.

The additional web members can be identical to the first web members. Possibly, a second plate can be arranged underneath the web and be united to the web.

The web members can be made of a same material, or can be made of two or more different materials, such as incompatible materials. Alternatively, or in addition, the additional web members can be made of a material incompatible with the material of the plate arranged on top. In the latter case, only the first and/or the second web members can be united to the plate on top. The additional web members thereby get interlocked in the same way as indicated in the first aspect and are preferably linked to the plate on top by no other means than by interlocking with the first and/or second web members united to the plate.

According to a third aspect of the invention, there is provided a panel unit of the structural kind that can be obtained by the above described method. The panel unit therefore comprises a first plate and continuous web members extending along intersecting directions so as to support the plate. The web members are each slotted partway through at the intersections so that they fit into one another. Web members extending along one of the intersecting directions comprise first slots partway through the web member and open-ended towards one side and second slots partway through the web member and open-ended towards the opposite side. Both the first slots and the second slots fit into slots of intersecting web members.

A second plate can be provided at the opposite side relative to the first plate to provide for a double-skinned panel, wherein the web members are interposed between the first and second plates. The panel unit according to the third aspect can comprise one or more features as described in relation to the first aspect.

DESCRIPTION OF EMBODIMENTS OF THE INVENTION

Figure 1:
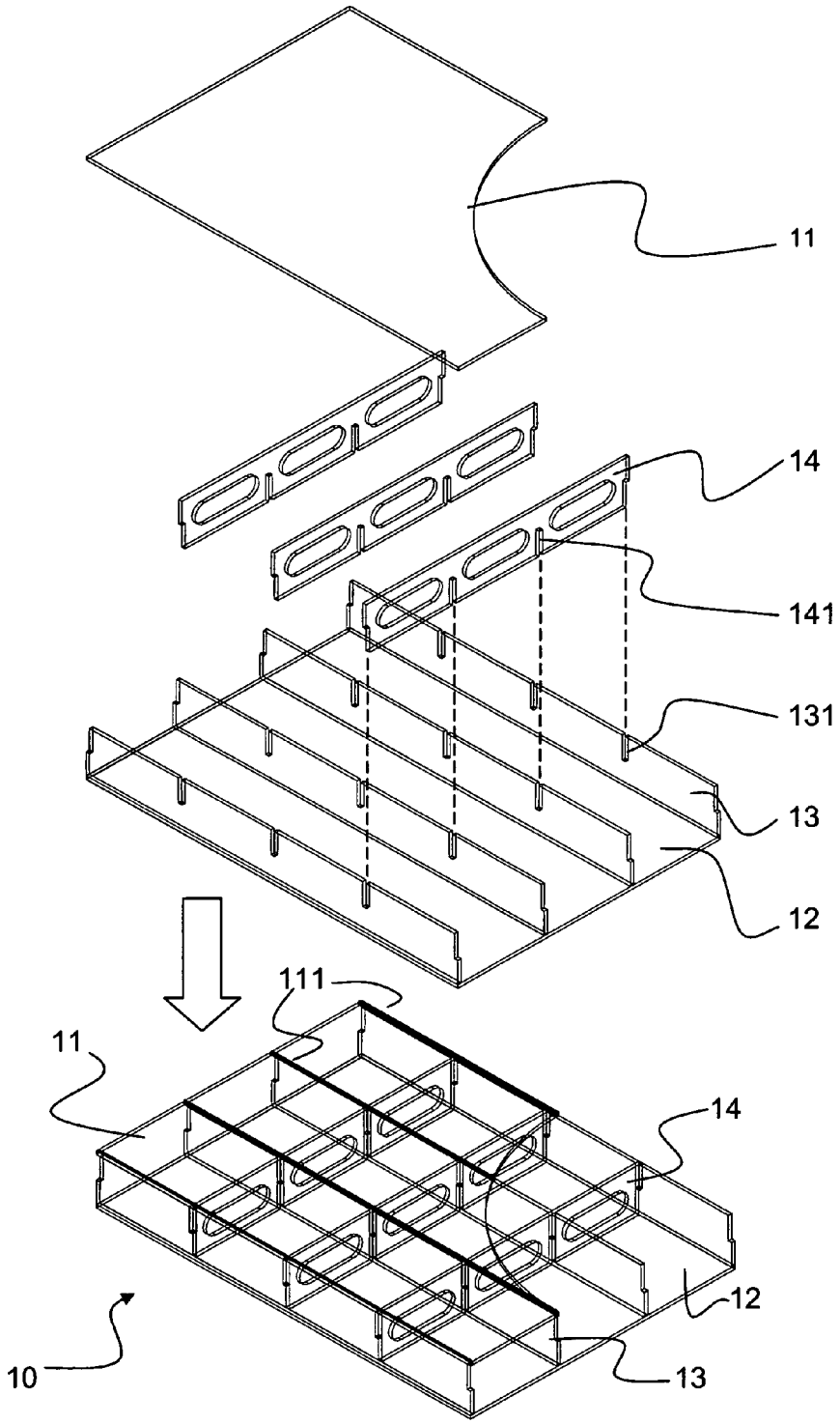
FIGS. 1 and 2 represent a panel unit according to the invention in exploded view and assembled view.

Referring to FIG. 1, a panel unit 10 comprises a top plate 11 and bottom plate 12, which are distanced apart by web members 13 and 14 disposed along intersecting lines. Web members 13 and 14 are continuous and preferably extend along the length and the width of the top and bottom plates. At the intersections, web members 13 and 14 comprise open-ended slots 131 resp. 141 extending partway through the height thereof. The slots have length enabling the web members 13 and 14 to fit into one another.

It is to be noted that the bottom plate 12 is optional, since it is possible to unite web members 14 directly to another structure.

The web members 13 and 14 can be of any form, such as hollow rectangular tubes, I-beams, L-beams, T-beams, but they are advantageously plates arranged in an upright position between the top and bottom plates. Such web member plates can be easily laser-cut out of a sheet in any form as desired.

According to an aspect of the invention, the top plate 11 is made of a first material, preferably a metal or metal alloy, even though the invention is not restricted to metal materials, but may include polymeric materials, in particular weldable polymeric materials, and even composites, such as fibre reinforced composites, in particular carbon fibre reinforced composites.

Web members 14 can be made of a second material, different from and incompatible with the first material.

Web members 13 can be made of the first material, or of a material different from and advantageously incompatible with the second material but compatible with and possibly similar to the first material.

Similarly, but not necessarily, bottom plate 12 can be made of the second material, or of a material compatible with and possibly similar to the second material.

Incompatible materials refer to materials that show neither mutual chemical, nor mutual physical affinity towards bonding, in particular towards at least one joining technique involving melting of the materials, such as welding. Incompatible materials can refer to materials whose bond cannot provide adequate mechanical or corrosion performance in view of the intended use. Incompatible materials include those materials which can only be welded through the use of an interlayer material. The terms bonding, fusion and welding therefore refer to the direct joining of materials, where there is physical contact and/or entanglement between the materials.

In the particular case of metals, and in the light of the above references, incompatible metals can refer to metallurgically incompatible metals. Incompatibility is likely between metals, the melting points of which are too different.

In the case of polymeric materials, incompatibility is likely between polymers with high differences in melting points or glass transition temperatures, or between amorphous and semi-crystalline polymers.

Specifically, when the uniting of web members and plate is being done by welding, compatible materials refer to materials for which at least one weldability window, defined in terms of operational industrial parameters, exists. For example, the usual parameters defining the weldability window in laser welding are the welding power P and the welding speed v. Within this weldability window, the weld must fulfil geometrical criteria (e.g. sufficient width and penetration of the weld), soundness criteria (e.g. volumetric or crack defects below a defined threshold), microstructural criteria (e.g. containing unacceptable intermetallic phases below a predetermined threshold) and mechanical criteria, all these criteria aiming to achieve the targeted properties for the weld. Thus, similar (compatible) materials with respect to laser welding are those for which at least one couple (P,v) makes it possible to obtain correct geometry, soundness, microstructure and satisfactory mechanical properties for the intended use and without recourse to additional materials for forming interlayers or fillers.

By way of example, one of the first and second materials can be steel and the other one can be aluminium. Alternatively, one of them can be stainless steel and the other one can be carbon steel.

Other incompatible materials can for example be formed with combinations of magnesium alloys, titanium alloys and copper alloys.

When the web members 13 are so disposed that they have at least one slot 131 open towards the top plate 11 and when web members 14 are disposed with slots 141 fitted into slots 131, one obtains that by uniting the web members 13 to the top plate 11, the web members 14 get interlocked by slots 131 and there is no need to unite the web members 14 to the top plate as well. Web members 14 are therefore linked to top plate 11 only by interlocking with web members 13. This has the advantage that web members 14 can for example be made of a material incompatible with the material of the top plate 11 and possibly also with the material of the web members 13.

Hence, there is no need to unite incompatible materials. Since web members 13 and top plate 11 can be made of compatible materials, uniting can be easily performed, such as by welding, preferably laser-welding, or any other bonding technique involving melting of the materials.

Bottom plate 12 and web members 14 can be made of different materials and the two can be united by other techniques, such as gluing, riveting, bolting, etc, in particular when either one material is not (easily) weldable. For example, by providing L-shaped or T-shaped web members, a contact surface can be created with the bottom plate 12 for gluing. However, it will be advantageous when bottom plate 12 and web members 14 are made of same (or compatible) materials, so as to ease uniting.

In the context of the invention, it will therefore be apparent that the materials of top and bottom plates can be different.

It follows that a panel unit can be obtained having at either side skins of different materials without the need of any bonding (welding) between the two materials.

Figure 2:
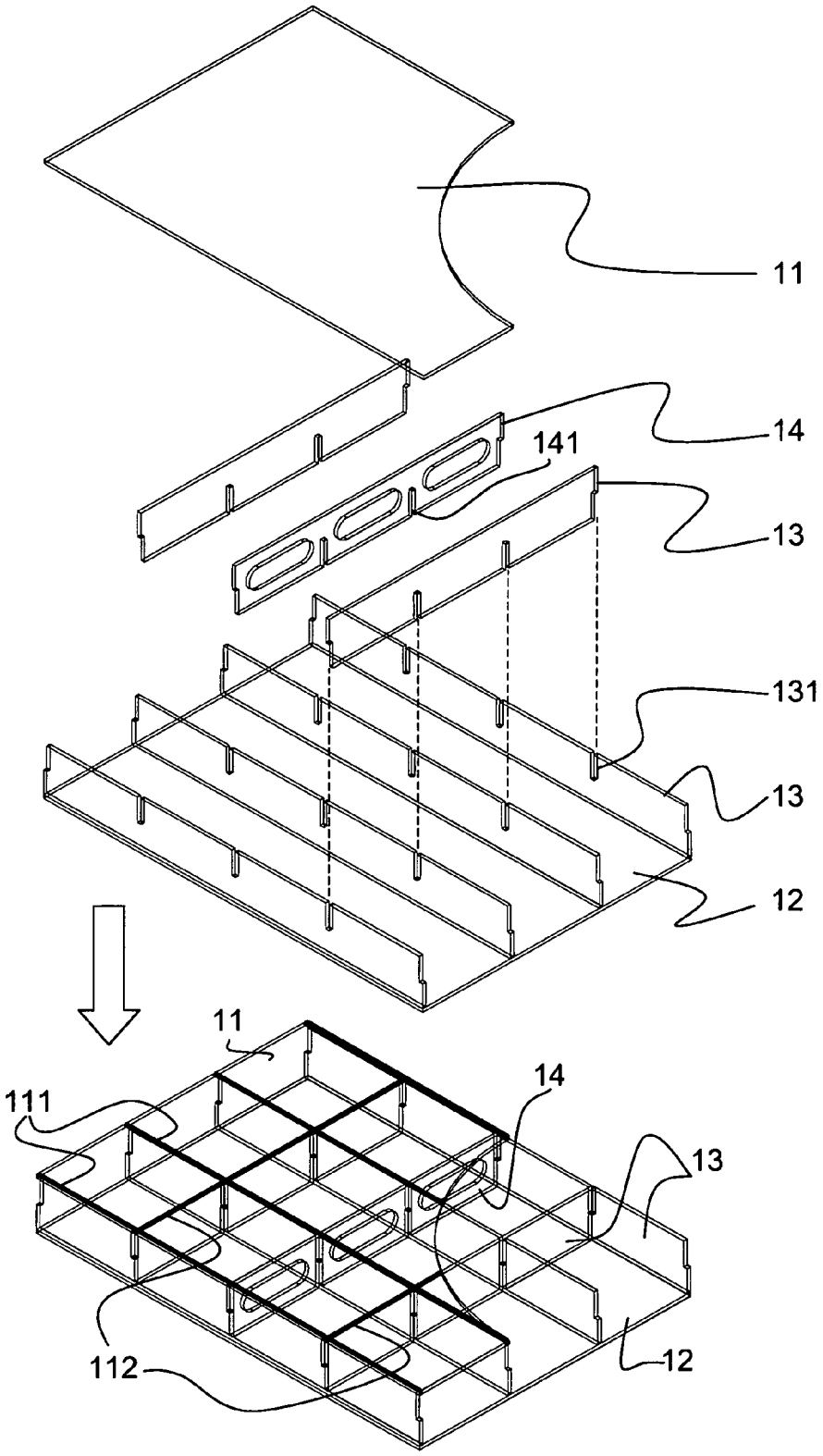

FIG. 1 shows the web members 13 being parallel to one another, intersecting web members 14 at right angles. Consequently, top plate 11 is united to the web structure (formed by web members 13, 14) along parallel lines 111 running along the web members 13. Joining lines 111 can e.g. be weld seams. Such a configuration is however not optimal for the transmission of shear stresses crosswise to these lines. When the latter is critical, some web members 13 can be disposed parallel to and possibly in replacement of some of the web members 14 as shown in FIG. 2. In the latter case, the top plate 11 can be united to the web structure 13, 14 along right-angled (weld) lines 111 and 112. A same reasoning can be applied to the web members 14 and the bottom plate 12.

It is to be noted that even though lines 111 and 112 are represented as continuous, this need not be so. For example, uniting can be performed by spot welding, creating intermittent weld spots along lines 111 and 112.

It is not essential that the web members are disposed at right angles to one another, even though such a disposition may be preferred for ease of manufacturing. They may intersect at other angles, e.g. to form rhomboidal cells. Likewise, more than two sets of intersecting lines may be thought of, such as to form triangular cells. Yet another alternative is to dispose the web members radially and tangential thereto (e.g. circular members). The latter disposition can be advantageous for panel units of circular shape.

Figure 6:
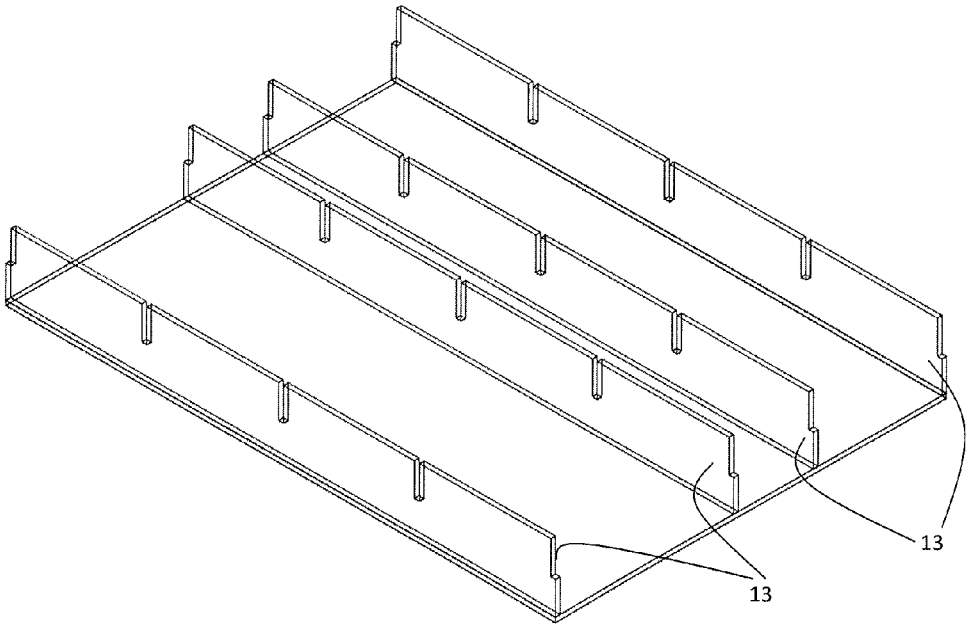
FIG. 6 is a perspective view of a panel unit which illustrates that distances between parallel web members can be variable.

The interspacing between web members disposed parallel need not be constant and can vary, as illustrated in FIG. 6, which shows only the web members 13 in one direction. In order to further save weight, more web members per unit distance can be provided where the load is higher or at locations subjected to point loads, so as to relieve other locations from being densely webbed.

All web members can be of same height. In particular, the web members advantageously extend over the distance between the top and bottom plate. Alternatively, additional web members can be provided in between other web members, the former having a smaller height, for example to improve dent resistance of the top plate.

It will be appreciated that the plate elements in panel units according to the present invention need not be planar and can be curved or have a graded thickness.

Another aspect of the invention is related to improvements in manufacturing and in particular assembling of panel units of the above kind. In fact, tailored solutions require that web member disposition and interspacing are changed almost every time, so that building the web structure may require each time new dedicated clamping/tooling and equipment, which is expensive. The problem is obviated as will be explained with reference to FIG. 3.

Figure 3:
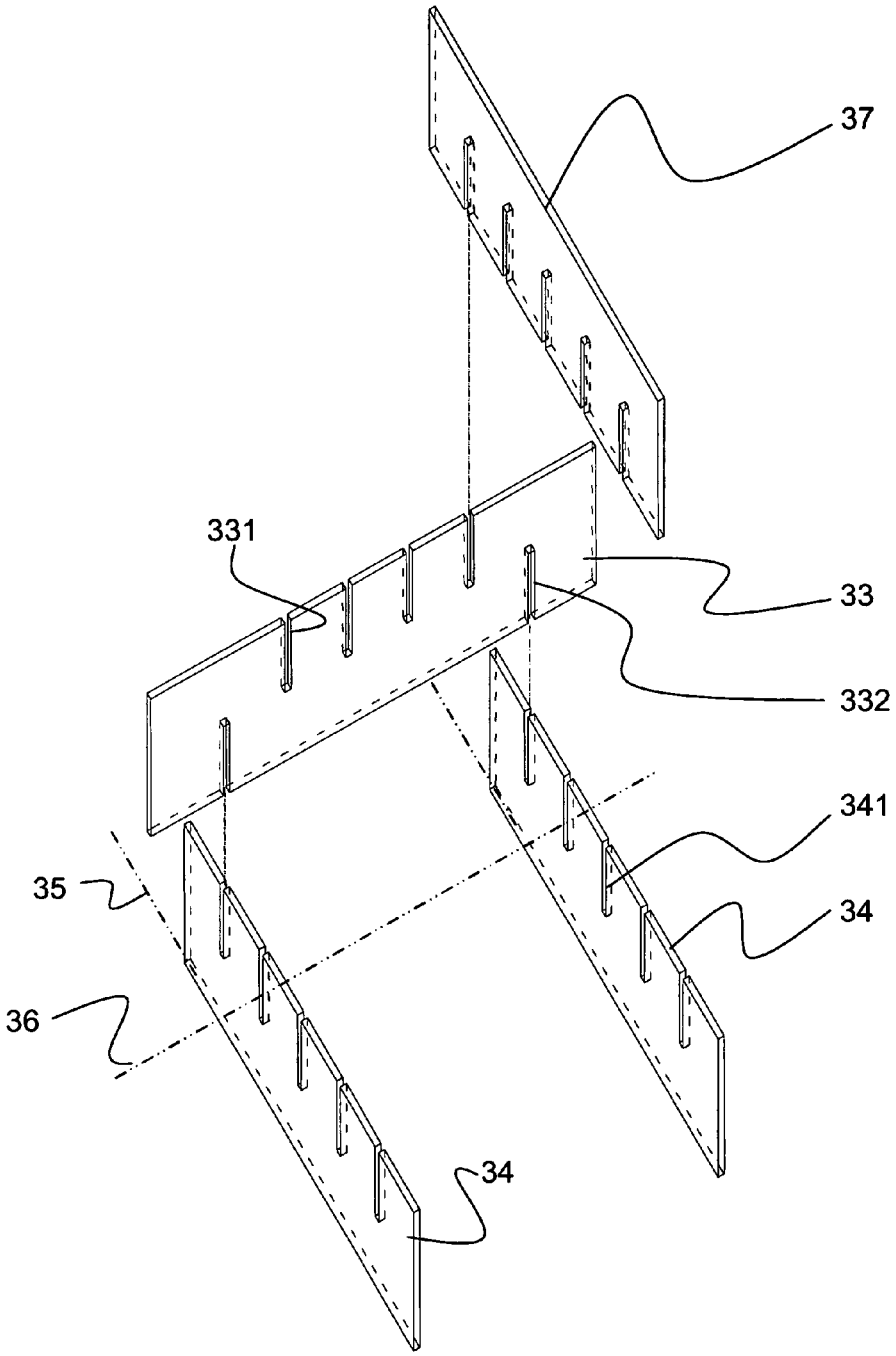
FIG. 3 represents how to assemble a web structure according to the second and third aspects of the invention.

In order to assemble the web structure, a self-standing framework of web members is built first. The framework comprises at least one (two are shown in FIG. 3) web member 34 arranged along a first direction 35 and so arranged that the web member 34 has slots 341 with upward facing open ends. Along a second intersecting direction 36 are arranged at least two web members 33, which have open ended slots 331 facing one side and a number (corresponding to the number of web members 34 in the framework) of open ended slots 332 facing the opposite side. To obtain the self-standing framework, web members 33 are disposed along direction 36 with slots 332 fitting in slots 341.

Once the framework is assembled, it can be further filled up with the remainder of web members 33 in the same way as indicated above. Finally, web members 37, which can be identical to web members 34 turned upside down are disposed to fit into slots 331 of web members 33 and the web structure is obtained.

The framework reduces manual intervention and the need for expensive clamping/tooling and equipment in aligning or positioning web members when building the web structure and hence eases assembly. In fact, the framework acts as tooling equipment for the web.

The web structure is subsequently covered with the top plate, which can be united to web members 33 and possibly to web members 34 as well.

The framework can be assembled on a bottom plate, so that once the web structure is completed, web members 37 and/or web members 33 can be all or in part united to the bottom plate.

As already stated, the top and bottom plates and the web members can be made of different, incompatible materials. However, the above described method of assembly can as well be beneficial for panel units composed of top and bottom plates and web members made of a same material, or similar, compatible materials.

Figure 4:
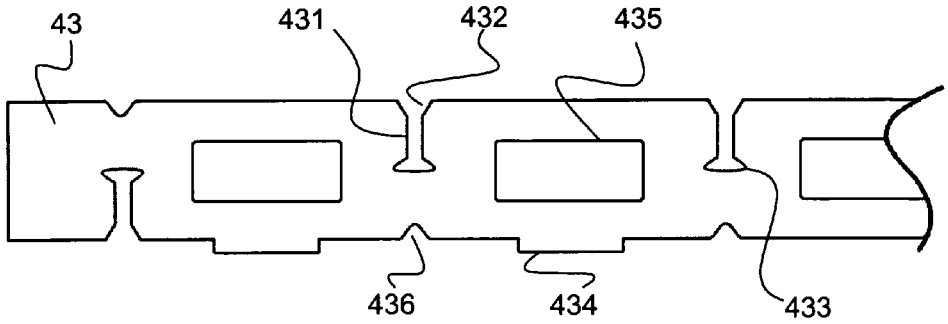
FIG. 4 represents a detail of a web member.

FIG. 4 shows a web member 43 including several optional possibilities, which can be incorporated alone or in combination into the web members of the invention. For example, web member 43 has slots 431 which are chamfered at their open ends 432 to ease assembly. The slot's blind ends 433 can be curved/rounded to improve fatigue resistance. The web member 43 can be provided with holes or openings 435 for weight reduction. Such holes can also be used for creating forced flow paths for liquids or gases for cooling/heating. Alternatively, or in addition, cable ducts can be provided through the holes.

To improve positioning of the top and/or bottom plates relative to the web structure, one or more web members can comprise projecting tabs 434 to fit corresponding slots in the top or bottom plate. The tabs 434 can have a height to project out of the top or bottom plate, for example for creating integrated lifting lugs or attachment eyelets.

Alternatively, or in addition, web members having larger height can be disposed along the edges of the panel unit to form elevated ridges. When providing the top or bottom plate on the web structure, the ridges form lateral abutments for the plate and the plate is easily centred.

Web members 43, in particular web members made of a material incompatible with the material of the top or bottom plate, can be provided with notches 436 opposite the slots 431 to prevent that the web member 43 is joined to the top or bottom plate during welding the other web members (made of a compatible material) to the top or bottom plate.

When uniting is performed by welding, it is possible to weld one plate to the web structure from the side of the web. In such case, the other plate, if any, will require welding from the outside, or any other joining or fastening technology. Therefore, it is possible to keep at least one external surface of the panel unit smooth and without weld seams, which can be beneficial for chemical or food processing applications as well as cosmetic appearance.

It is to be noted that the welding between web members and corresponding plates is not necessarily continuous. An advantageous possibility is to weld the webs only in the intersecting areas or in between the intersections.

Figure 5:
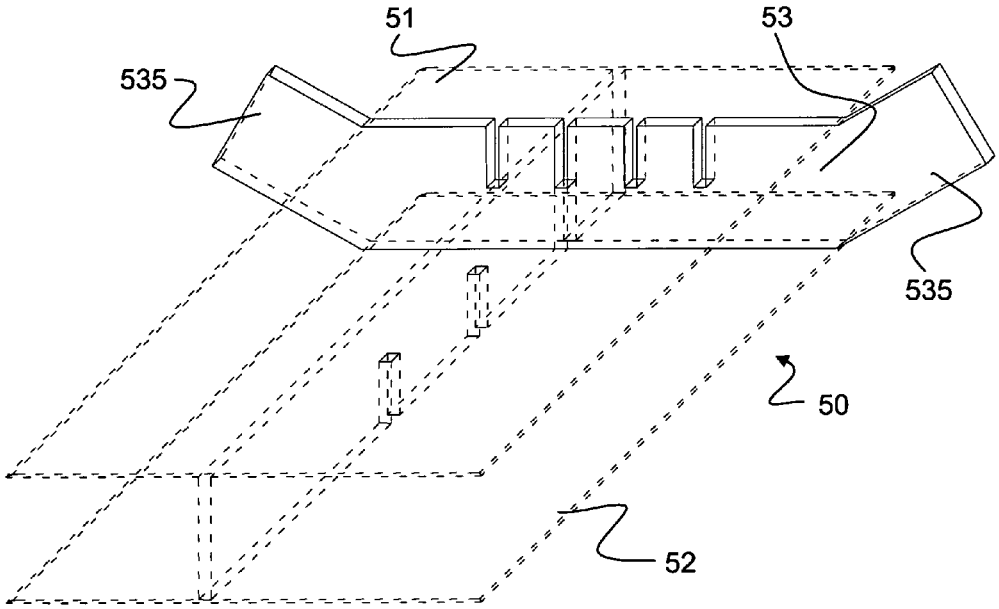
FIG. 5 represents a particular web member according to the invention.

It is possible to unite different structural panel units sideways together to form larger structural elements. An option for doing so is to let a number of web members 53 project past the edges of top and/or bottom plates 51, resp. 52, as shown in FIG. 5. The projecting sections will also ease handling of the panel units, as they can provide for example eyes for attaching hooks. When the projecting sections are inserted into other panel units so that they fit between top and bottom plates, panel units can easily be united to one another to create an integral structure.

FIG. 5 shows a web member 53 with outwardly projecting sections 535 that are inclined relative to the panel unit 50 to form tank or container structures.

According to an aspect of the invention, no other means of bonding/joining need be provided at intersections where web members fit with their slots into one another, since the slots are so arranged that interlocking between cross-laid web members is obtained. As a result, incompatible materials can be incorporated into the panel unit without the need of bonding incompatible materials.

Figure 7:
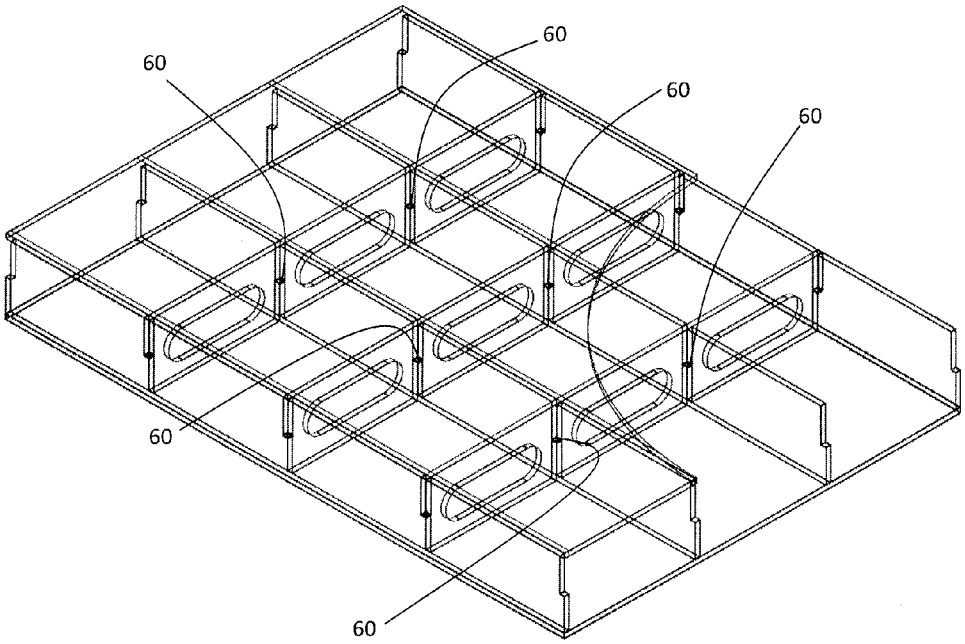
FIG. 7 is a perspective view of a panel unit that shows the use of visco-elastic elements at the intersection of two intersecting web members.

As illustrated in FIG. 7, rubber elements 60, or of another elastic or visco-elastic material can be provided at the web members' intersections for acoustic and/or vibration damping.

Panel units according to aspects of the invention can find use in non-structural applications as well.

The invention claimed is:

1. Structural panel unit comprising a first plate and continuous web members extending along intersecting directions so as to support the plate, the web members intersecting each other, the web members comprising open-ended slots at their intersections, the slots extending partway through the height of the web members so that the web members fit into one another, the web members comprising first web members and second web members, wherein the first web members are so disposed as to have slots open towards the first plate in which slots fit the second web members, wherein the first web members are united to the first plate thereby interlocking the second web members, and wherein the second web members are linked to the first plate by no other means than by interlocking with the first members.

2. Structural panel unit of claim 1, wherein the first plate is made of a first material and the second web members are made of a second material, different from the first material.

3. Structural panel unit of claim 2, wherein the first web members are united to the first plate by welding and wherein the first and second materials are incompatible materials with regard to welding.

4. Structural panel unit of claim 3, wherein the first web members are made of the first material or a material compatible with the first material.

5. Structural panel unit of claim 3, wherein the first material is a first metal or metal alloy and the second material is a second metal or metal alloy.

6. Structural panel unit of claim 1, comprising a second plate and wherein first and second plates are distanced apart and united together by the web members which are interposed between.

7. Structural panel unit of claim 6, wherein the second web members are so disposed as to have slots open towards the second plate and are united thereto thereby interlocking the first web members, and wherein the first web members are linked to the second plate by no other means than by interlocking with the second members.

8. Structural panel unit of claim 1, wherein first web members extend along a first direction and second web members extend along a second direction intersecting with the first direction.

9. Structural panel unit of claim 1, wherein first web members comprise web members extending along a first direction and web members extending along a second direction intersecting with the first direction.

10. Structural panel unit of claim 9, wherein the second web members extend along one of the first and second directions.

11. Structural panel unit of claim 1, wherein the second web members comprise notches opposite the slots.

12. Structural panel unit of claim 1, wherein slots of web members are chamfered at their open ends.

13. Structural panel unit of claim 1, wherein web members extending along at least one of said intersecting directions are distanced apart at varying distances.

14. Structural panel unit of claim 1, wherein web members extending along one of said intersecting directions comprise first partway through slots open towards one side and second partway through slots open towards the opposite side, the first and second slots fitting into intersecting web members.

15. Structural panel unit of claim 1, comprising web members extending along edges of the panel unit which have a larger height than other web members, so as to form an elevated ridges against which one of or both the first and second plates abuts laterally.

16. Structural panel unit of claim 1, wherein at least some web members extending along at least one of said intersecting directions comprise sections extending outwardly of the edges of the first and/or second plates.

17. Structural panel unit of claim 1, comprising a visco-elastic material at an intersection of the web members.

18. Structural panel unit according to claim 1, wherein web members extending along one of said intersecting directions comprise first partway through slots open towards one side and second partway through slots open towards the opposite side, the first and second slots fitting into slots of intersecting web members.

19. Structural panel unit of claim 18, wherein at least some web members have slots open ended towards the first plate and are united to the first plate thereby interlocking the remainder of the web members.

20. Method of assembling the structural panel unit of claim 1, comprising:

providing at least one first continuous web member and second continuous web members being each slotted partway through so that the first web member and second web members can fit into one another, wherein the second web members comprise slots open-ended towards one side and other slots open-ended towards the opposite side, arranging the at least one first web member so as to have upwardly facing slots, arranging the second web members so as to intersect the first web member and to interlock therewith by slot-fitting the slots open-ended towards the one side with slots of the first web member, arranging additional web members by slot-fitting into slots of the second web members open-ended towards said opposite side, thereby obtaining a web, and arranging a plate on top of the web and uniting the plate to the web to obtain the panel unit.

21. Method of claim 20, wherein the plate is made of a first material and the additional web members are made of a second material incompatible with the first material, and wherein the plate is united to the first and/or second web members thereby interlocking the additional web members.

22. Method of claim 20, wherein uniting is performed by welding.

* * * * *